United States Patent [19]

Pearl

[11] 4,294,047

[45] Oct. 13, 1981

[54] METHOD OF SHARPENING LATERAL EDGES AND END EDGES OF A BLADE DURING RECIPROCATION THEREOF

[75] Inventor: David R. Pearl, West Hartford, Conn.

[73] Assignee: Gerber Garment Technology, Inc., South Windsor, Conn.

[21] Appl. No.: 111,527

[22] Filed: Jan. 14, 1980

[51] Int. Cl.[3] ..... B24B 1/00; B24B 3/36

[52] U.S. Cl. ..... 51/327; 51/247; 83/174

[58] Field of Search ..... 51/246, 247, 249, 285, 51/327; 83/174; 30/139

[56] References Cited

U.S. PATENT DOCUMENTS

| | | | |
|---|---|---|---|
| 1,303,936 | 5/1919 | Maimin et al. | 51/246 X |
| 1,305,480 | 6/1919 | Maimin | 51/246 X |
| 3,507,177 | 4/1970 | Baldwin | 51/247 X |
| 3,703,056 | 11/1972 | Langhoff | 51/246 |
| 4,033,214 | 7/1977 | Pearl | 51/247 X |

*Primary Examiner*—Gary L. Smith

*Attorney, Agent, or Firm*—McCormick, Paulding & Huber

[57] ABSTRACT

The leading and lower cutting edges of a reciprocating cutting blade on a sheet material cutting apparatus are sharpened by elevating the blade from a cutting region proximate the sheet material supporting surface of the apparatus to a sharpening region above the cutting region and reciprocating the blade within the sharpening region. The apparatus includes two sharpening wheels mounted on a pivoted yoke and supported at opposite sides of the blade. One of the sharpening wheels is biased toward the blade to bring a face of the one wheel into sharpening engagement with one side of the leading cutting edge of the blade. The face of the one wheel is maintained in sharpening engagement with the leading cutting edge during a substantial portion of the blade sharpening stroke in either direction, however, as the blade approaches the upper limit of its sharpening stroke the one sharpening wheel is moved under the leading edge of the blade to bring a peripheral edge portion of the wheel into sharpening engagement with the lower cutting edge of the blade. The peripheral edge of the wheel is maintained in engagement with the lower cutting edge during the remaining portion of the upward sharpening stroke and during the initial portion of the downward sharpening stroke. The other sharpening wheel is moved in like manner to sharpen the other side of the leading and lower edges of the blade.

7 Claims, 8 Drawing Figures

METHOD OF SHARPENING LATERAL EDGES AND END EDGES OF A BLADE DURING RECIPROCATION THEREOF

BACKGROUND OF THE INVENTION

This invention relates in general to apparatus for cutting sheet material and deals more particularly with a method for sharpening the cutting edges of a blade on a numerically controlled cutting apparatus of the type used in cutting pattern pieces from sheet material layups.

The use of numerically controlled cutting tools in the garment, automotive and other industries where fabric cutting is required is well established. Such numerically controlled equipment is capable of simultaneously cutting large numbers of pattern pieces from layups of material with high speed and accuracy. A cutting program controls operation of the cutting tool and causes it to translate through a layup which comprises high or deep layers of material while the layup is held in spread condition on a cutting table. Relative movement between the cutting blade and the layups can be produced by moving the cutting blade or the layup or both under program control, as it is well known in the art.

Apparatus of the aforedescribed general type has been developed which utilizes a vertically reciprocating blade sharpened along both its leading and lower edges. Such apparatus, which may be used to cut material with both slicing and chopping action, is particularly advantageous for use in cutting tough material, such as denim and upholstery fabrics, and allows cutting of relatively high piles of such difficult-to-cut materials. However, the cutting edges of the blade must be kept in sharpened condition to maintain the efficiency and speed of the cutting apparatus and to avoid occurrence of ragged edges on cut woven materials.

Heretofore, apparatus and methods have been available for sharpening only the leading edges of reciprocating cutting blades on apparatus of the aforedescribed general type. Typical blade sharpeners of this type and which utilized this method of sharpening are illustrated and described in my U.S. Pat. No. 4,033,214, issued July 5, 1977, and assigned to the assignee of the present application, and in U.S. Pat. No. 3,507,177, to Baldwin, issued Apr. 21, 1970, and assigned to Cincinnati Milling Machine Co., Cincinnati, Ohio. The apparatus and methods illustrated by the aforesaid patents are quite suitable for sharpening a blade which cuts with a slicing action and wherein a lower sharpened edge of the blade is used only occasionally, as in initially penetrating the material to be cut. However, a problem is encountered in sharpening the lower cutting or chopping edge and maintaining the latter edge of a blade in sharpened condition when the blade is used to cut with a chopping action. The present invention is concerned with this problem.

SUMMARY OF THE INVENTION

In accordance with the present invention, an improved method is provided for sharpening the cutting edge of a reciprocating blade on a sheet material cutting apparatus which has a blade supported for generally vertical reciprocating movement relative to a horizontal sheet material supporting surface. The blade has a generally vertically extending leading cutting edge and a lower cutting edge which intersects the leading cutting edge and extends downwardly therefrom and in the direction of the blade trailing edge. The apparatus has a cutting region proximate the sheet material cutting surface, a blade sharpening region above the cutting region, and at least on driven blade sharpening wheel supported within the cutting region. In accordance with the improved method the blade is elevated from the cutting region to the sharpening region and reciprocated within the sharpening region. The one sharpening wheel is biased toward the blade and into sharpening engagement with the leading cutting edge as the blade moves upwardly from the lower toward the upper limit of its sharpening stroke. As the blade approaches and moves to the upper limit of its sharpening stroke the sharpening wheel is moved under the leading edge of the blade and into sharpening engagement with the lower cutting edge of the blade.

DESCRIPTION OF PREFERRED METHOD

Figure 1:
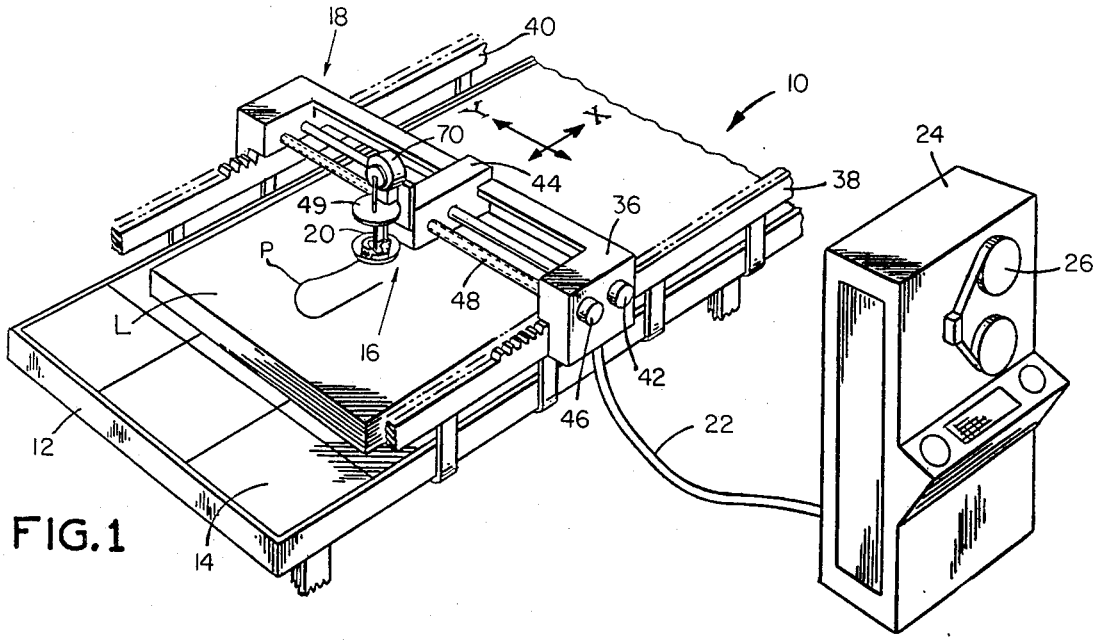
FIG. 1 is a fragmentary perspective view of a typical sheet material cutting apparatus of the type used in practicing the method of the present invention.

Referring now to the drawings, FIG. 1 illustrates a typical cutting apparatus of type used in practicing the sharpening method of the present invention. The cutting apparatus 10 comprises an automatically controlled cutting machine which cuts with both slicing and chopping action and which may be utilized to cut multi-ply layups of sheet material, such as woven and non-woven fabrics, paper, cardboard, leather, rubber and synthetics. The illustrated machine 10 includes a table 12 which has a penetrable bristle bed defining a material supporting surface 14 upon which a layup, such as the layup L shown in FIG. 1 may be supported. A cutting head indicated generally at 16 supported above the surface 14 on a movable carriage assembly, indicated generally at 18, carries a reciprocating cutting blade 20. The illustrated machine 10 is connected by an electrical cable 22 to a controller 24 which converts data from a program tape 26 into machine commands for guiding the reciprocating blade 20 along a cutting path P, within a cutting region proximate the surface 14 and in cutting engagement with the layup L. The path P may, for example, be the periphery of the pattern piece which forms part of a garment or an upholstery panel.

Figure 6:
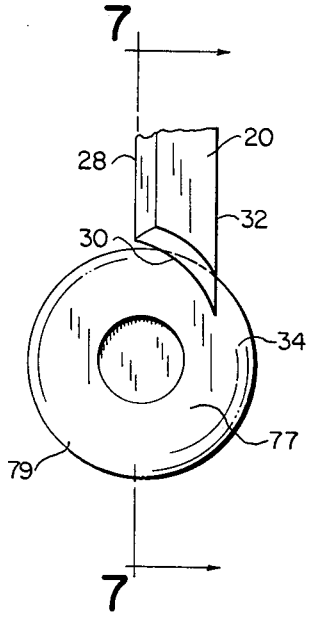
FIG. 6 is a fragmentary side elevational view of the sharpening wheel and blade as shown in FIG. 5.
Figure 2:
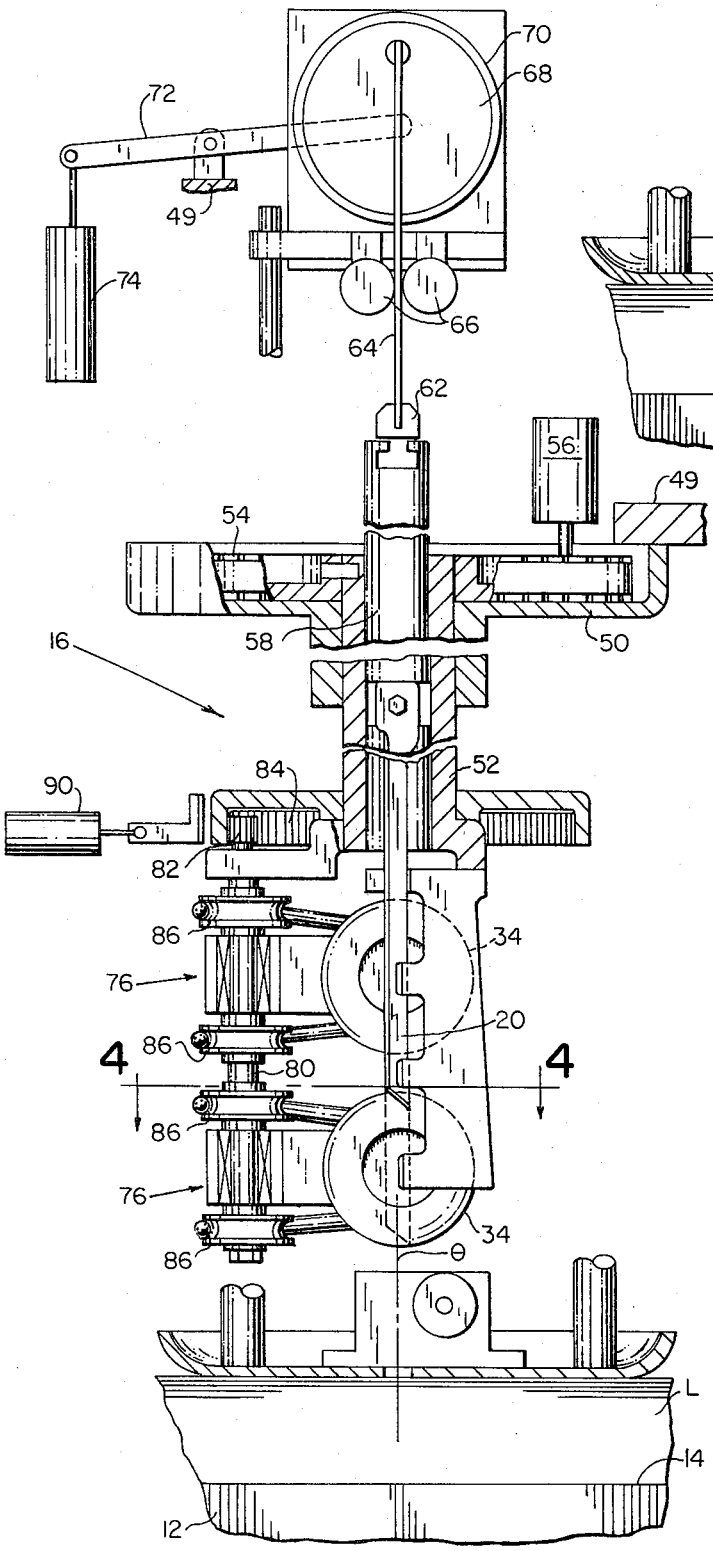
FIG. 2 is a somewhat enlarged fragmentary side elevation of the machine of FIG. 1 shown with its blade elevated to the sharpening region and illustrates the method of the present invention.
Figure 3:
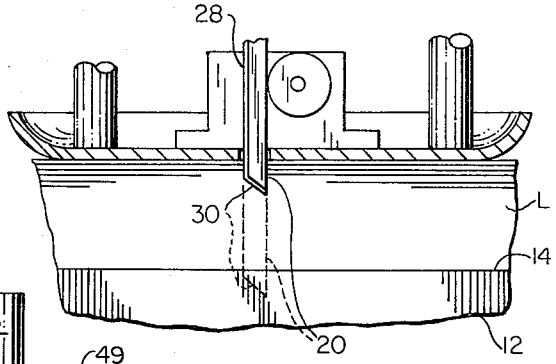
FIG. 3 is a fragmentary side elevational view similar to FIG. 2 but shows the blade in its cutting region.

The blade 20, best shown in FIGS. 2, 3 and 6, is supported for vertical reciprocation and has a generally vertically extending leading cutting edge 28 and a lower cutting edge 30 which intersects the leading cutting edge and extends downwardly from it and in the direction of the blade trailing edge, indicated at 32. The apparatus 10 further includes at least one sharpening wheel 34 supported within a sharpening region above the cutting region, and means for elevating the blade 20 to the blade sharpening region, shown in FIG. 2, where it vertically reciprocates with a sharpening stroke between upper and lower limits respectively shown in full and broken lines in FIG. 2. The apparatus 10 further includes a means for moving the one sharpening wheel 34 into sharpening engagement with the blade 20, as will be hereinafter further discussed.

Considering now the apparatus 10 in further detail, the carriage assembly 18 includes an X carriage 36 which is supported to translate relative to the table surface 14 in the illustrated X-coordinate direction on a set of racks 38 and 40. Pinions (not shown) respectively engage with the racks 38 and 40 and are driven by an X-drive motor 42 in response to signals received from the controller 24. A Y carriage 44 is mounted on the X carriage 36 for movement with the X carriage and in Y-coordinate directions relative to the X carriage and the table surface 14 by a Y-drive motor 46 and an associated lead screw 48 connected between the Y-drive motor and the Y carriage. The cutting head 16 is carried on a platform 49 attached to a projecting end of the Y carriage 44.

In FIG. 2 further details of the cutting head 16 are shown somewhat schematically. The cutting head has a housing 50 which is bolted to the platform 49 and carries a hollow shaft or sleeve 52 which is journaled in the housing for rotation about a vertically disposed $\phi$ axis. A belt driven timing pulley 54 located within the housing 50 is keyed to the upper end of the sleeve 52 and is driven by a drive motor 56 in response to signals from the controller 24. The blade 20 is mounted on the lower end of a sliding link 58 slidably received within a non-circular bore in the sleeve 52. The upper end of the link 60 is secured by a swivel connection 62 to a flexible link 64 supported by guide rollers 66, 66 and driven by a rotating eccentric 68 connected to another drive motor 70. Thus, the blade 20 is supported for reciprocating movement in response to rotation of the eccentric 68 and for rotation about the $\phi$ axis in response to signals received by the drive motor 56 from the controller 24.

The drive mechanism for reciprocating the blade 20 and which includes the eccentric 68 is supported on one end of a pivoted link 72 which is mounted to pivot about a horizontal axis fixed relative to the platform 49. A solenoid 74 connected to the other end of the link 72 operates to pivot the link in one or the opposite direction about its axis in response to signals received from the controller 24 to elevate the blade to reciprocate within the sharpening region, shown in FIG. 2, or to lower it to reciprocate within its cutting region, shown in FIG. 3, the upper and lower limits of its cutting stroke being shown in full and broken lines in FIG. 3.

Figure 7:
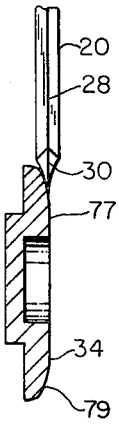
FIG. 7 is a fragmentary sectional view taken along the line 7—7 of FIG. 6.

The illustrated machine 10 includes two sets of sharpening wheels indicated generally at 76, 76. Each set of wheels 76 includes two sharpening wheels 34, 34 journaled for rotation about horizontal axes on an associated yoke 78. Each sharpening wheel 34 has a substantially flat face portion 77 which is disposed in a radial plane substantially perpendicular to the sharpening wheel axis and an annular portion 79, as best shown in FIGS. 6 and 7. The yokes 78, 78 are supported on a shaft 80 which is journaled on and suspended from a radial projection on the sleeve 52. A pinion 82 keyed to the upper end of the shaft 80 intermeshingly engages a ring gear 84 supported for free rotation on the lower end of the sleeve 52. Drive pulleys 86, 86 mounted on the shaft are connected by drive belts to associated pulleys 88, 88 mounted on the shafts which carry the sharpening wheels 34, 34. A solenoid operated brake 90 engageable with the ring gear 84 and operable in response to signals from the controller 24 operates to secure the ring gear against rotation relative to the platform 49.

During the normal cutting cycle, the blade 20 is lowered to its cutting position and reciprocates within the cutting region in cutting engagement with a layup, such as the layup L, as shown in FIG. 3. The reciprocating blade 20 moves along a path, such as the path P, in response to coordinated movements of the X and Y carriages 36 and 44 in accordance with the taped program in the controller 12. The blade is further oriented about its $\phi$ axis in response to signals received by the drive motor 56 from the controller 24 so that the blade is maintained in generally tangential orientation relative to the path P. The blade cuts with both a chopping and a slicing action as it advances through the layup.

Apparatus of the type hereinbefore described is further illustrated and described in my U.S. Pat. No. 4,033,214 for BLADE SHARPENER, issued July 5, 1977, and assigned to the same assignee of the present invention, and is hereby adopted by reference as a part of the present disclosure.

Figure 4:
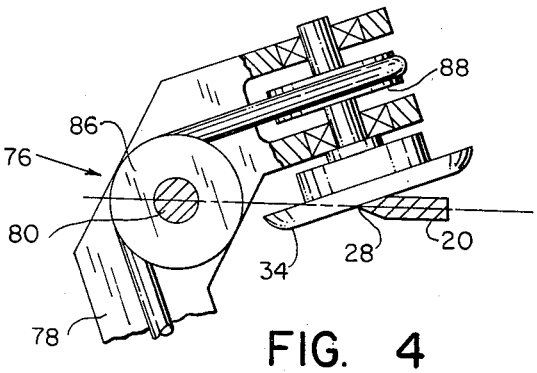
FIG. 4 is a somewhat schematic fragmentary sectional view taken along the line 4—4 of FIG. 2, shows the blade at the lower limit of its sharpening stroke, and illustrates a method of the invention.
Figure 5:
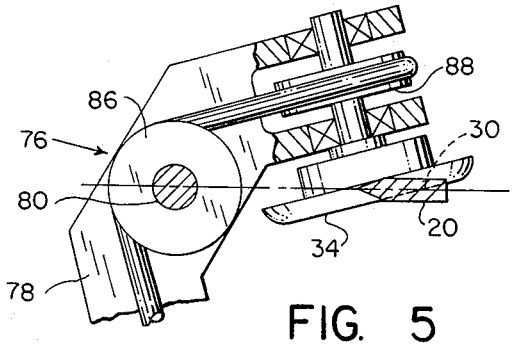
FIG. 5 is similar to FIG. 4, but shows the blade at the upper limit of its sharpening stroke and illustrates a further step in the method.

The blade is sharpened by elevating it from the cutting region, shown in FIG. 3, to the sharpening region, shown in FIG. 2 and reciprocating it within the sharpening region. At least one of the sharpening wheels 34 is biased into sharpening engagement with the blade by operating the drive motor 56 while the blade 20 is reciprocating within the sharpening region. Because of the eccentric mounting of the yokes 76 centrifugal force causes one or the other of the sharpening wheels 34, 34 to be biased into sharpening engagement with an associated side of the blade 20. The brake 90 is operated to secure the ring gear 84 in fixed position relative to the platform 49 so that rotation of the sleeve 52 relative to the ring gear causes the pinion 82 to drive the shaft 80 and thereby rotate the sharpening wheels 34, 34 in sharpening engagement with the blade 20. The lower sharpening wheel 34 shown in FIG. 2 is maintained in sharpening engagement with an associated side of the leading cutting edge 28 as the blade moves upwardly from the lower limit toward the upper limit of its sharpening stroke. As the blade 20 approaches and moves to the upper limit of its travel within the sharpening region the lower wheel 34 is moved under the leading edge of the blade 20 from the position shown in FIG. 4 toward the position shown in FIG. 5 and in sharpening engagement with the lower cutting edge 28. More specifically, as the blade 20 travels upwardly from its lower limit toward the upper limit of its sharpening strokes. The face 77 of the lower sharpening wheel 34 is biased into sharpening engagement with an associated side face of the leading cutting edge 26. As the blade approaches and moves to the upper limit of its sharpening stroke the peripheral portion 79 of the wheel is moved into sharpening engagement with the lower cutting edge 30. It should be noted that the lower end portion of the blade 20 is in sharpening engagement with the sharpening wheel 34 when the blade reaches the upper limit of its sharpening stroke, as shown in FIG. 6, where the blade is shown at its upper limit relative to the wheel 34. Thus, engagement of a lower sharpening wheel 34 with the lower end portion of the blade effectively limits pivotal movement of the lower yoke assembly. In accordance with the invention, only the lower yoke assembly, shown in FIG. 2, is used to sharpen the lower cutting edge 30. However, the upper yoke assembly functions in conventional manner to sharpen the upper portion of the leading cutting edge 26. It will be appreciated that the other sharpening wheels 34, 34 at the opposite side of the blade 20 may be brought into sharpening engagement with the blade by reversing the direction of rotation of the blade 20 and its supporting structure about the $\phi$ axis.

The aforesaid sharpening method produces a generally arcuate undercut lower cutting edge 30, as shown in FIG. 6, which is particularly desirable where the blade is used to cut with a chopping action. The method is or may be performed while the blade is being moved relative to the table surface 24 under the programmed control of the controller 24. Thus, the blade may be sharpened while it is moved from one cutting position to another on a layup and without loss of cutting time.

Figure 8:
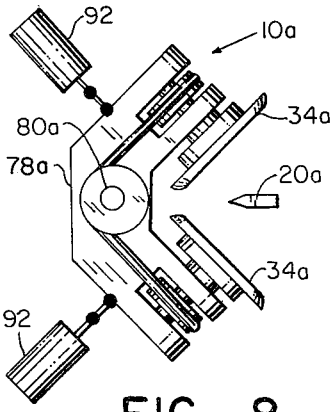
FIG. 8 is a fragmentary sectional view similar to FIG. 4, but shows another blade sharpening apparatus.

Referring now to FIG. 8 a modified form of the apparatus is shown and indicated generally by the reference numeral 10*a*. The apparatus 10*a* has a pivoted yoke 78*a* for moving one or the other of two sharpening wheels 34*a*, 34*a* into sharpening engagement with an associated blade 20*a*. However, the apparatus 10*a* differs from the apparatus 10, previously described, in that it does not rely upon centrifugal force to bias one or the other of the sharpening wheels into engagement with the blade. Rather, the apparatus 10*a* is provided with a pair of solenoids 92, 92 which are connected by linkages to the yoke 78*a* and which move it in one or the other direction about its pivot to bias it toward and move it into sharpening engagement with associated cutting edges of the blade in response to signals received from a controller. An apparatus which uses a positive drive mechanism, such as a solenoid, to bias a sharpening wheel toward and move it in sharpening engagement with an associate reciprocating blade is shown in U.S. Pat. No. 3,507,177 to Baldwin for APPARATUS FOR SHARPENING RECIPROCATING CUTTING BLADE OF MATERIAL CUTTING MACHINE, issued Apr. 21, 1970, and assigned to the Cincinnati Milling Machine Co., Cincinnati, Ohio. The afore-identified patent to Baldwin is hereby adopted by reference as a part of the present disclosure.

I claim:

1. A method for sharpening the cutting edges of a reciprocating blade on a sheet material cutting apparatus, the blade being supported for generally vertical reciprocating movement relative to a generally horizontal sheet material supporting surface and having a generally vertically extending leading cutting edge and a lower cutting edge intersecting the leading cutting edge and extending downwardly therefrom and in the direction of the blade trailing edge, the apparatus having a cutting region proximate the sheet material supporting surface and a blade sharpening region above the cutting region, and at least one blade sharpening wheel supported within the cutting region, said method comprising the steps of elevating the blade from the cutting region to the blade sharpen region, reciprocating the blade within the sharpening region, biasing the one sharpening wheel toward the blade and into sharpening engagement with the leading cutting edge of the blade and maintaining the one sharpening wheel in sharpening engagement with the leading cutting edge as the blade moves upwardly from a lower limit toward an upper limit within the sharpening region, and moving the one sharpening wheel under the leading edge of the blade and in sharpening engagement with the lower cutting edge of the blade as the blade approaches and moves to the upper limit of its travel within the sharpening region.

2. A method for sharpening the cutting edges of a reciprocating blade as set forth in claim 1 wherein the step of biasing the one sharpening wheel is further characterized as biasing one portion of the one sharpening wheel into sharpening engagement with the leading cutting edge of the blade and the step of moving the one sharpening wheel under the leading edge is further characterized as moving another portion of the one sharpening wheel in sharpening engagement with the lower cutting edge.

3. A method for sharpening the cutting edges of a blade as set forth in claim 2 wherein the step of biasing one portion of the one sharpening wheel is further characterized as biasing a face of the one sharpening wheel into sharpening engagement with the leading cutting edge and the step of moving another portion of the one sharpening wheel is further characterized as moving a peripheral portion of the one sharpening wheel in sharpening engagement with the lower cutting edge.

4. A method for sharpening the cutting edge of a blade as set forth in any one of claims 1 to 3 including the additional step of controlling the upward movement of the blade to maintain the lower end portion of the blade in sharpening engagement with the one sharpening wheel when the blade reaches the upper limit of its stroke within the sharpening region.

5. A method for sharpening the cutting edges of a reciprocating blade as set forth in any one of claims 1 to 3 wherein the step of moving the one sharpening wheel is further characterized as moving the one sharpening wheel under the leading edge of the blade and along an arcuate path in sharpening engagement with the lower cutting edge of the blade.

6. A method for sharpening the cutting edges of a reciprocating blade on a sheet material cutting apparatus, the blade being supported for movement with a vertical reciprocating stroke relative to a generally horizontal sheet material supporting surface and having a generally vertically extending leading cutting edge and a lower cutting edge intersecting the leading cutting edge and extending downwardly therefrom and in the direction of the blade trailing edge, the apparatus having a cutting region proximate the sheet material supporting surface and a blade sharpening region above the cutting region, and at least one blade sharpening wheel supported within the cutting region, said method comprising the steps of providing the blade sharpening wheel with an abrasive surface including a substantially flat face portion disposed in a radial plane substantially perpendicular to the blade sharpening wheel axis and an annular peripheral portion, supporting the blade sharpening wheel for rotation about a horizontal axis, elevating the blade from the cutting region to the blade sharpening region, reciprocating the blade within the sharpening region, biasing the flat portion of the blade sharpening wheel toward the reciprocating blade and into sharpening engagement with the leading cutting edge of the blade, maintaining the flat portion of the blade sharpening wheel in sharpening engagement with the leading cutting edge as the reciprocating blade moves upwardly and downwardly within the sharpening region, and moving the blade sharpening wheel under the leading edge of the blade with the peripheral portion in sharpening engagement with the lower cutting edge of the blade as the blade approaches and moves away from the upper limit of its stroke within the sharpening region.

7. A method for sharpening the cutting edges of a reciprocating blade as set forth in claim 6 wherein the step of moving the blade sharpening wheel is further characterized as moving the blade sharpening wheel under the leading edge of the blade and along an arcuate path in sharpening engagement with the lower cutting edge.

* * * * *